US007564985B2

(12) United States Patent
Yamamoto et al.

(10) Patent No.: US 7,564,985 B2
(45) Date of Patent: Jul. 21, 2009

(54) CONDENSER MICROPHONE AND METHOD OF MANUFACTURING SUBSTRATE THEREFOR

(75) Inventors: Akira Yamamoto, Nara (JP); Yasuo Sugimori, Nabari (JP)

(73) Assignee: Hosiden Corporation, Osaka (JP)

( * ) Notice: Subject to any disclaimer, the term of this patent is extended or adjusted under 35 U.S.C. 154(b) by 867 days.

(21) Appl. No.: 11/270,904

(22) Filed: Nov. 10, 2005

(65) Prior Publication Data

US 2006/0104468 A1 May 18, 2006

(30) Foreign Application Priority Data

Nov. 16, 2004 (JP) ..... 2004-331503
Nov. 7, 2005 (JP) ..... 2005-322465

(51) Int. Cl.
*H04R 25/00* (2006.01)

(52) U.S. Cl. ..... 381/174; 381/175

(58) Field of Classification Search ..... 381/174, 381/175, 190, 191, 369
See application file for complete search history.

(56) References Cited

FOREIGN PATENT DOCUMENTS

EP 1 473 996 11/2004
JP 2003-163997 11/2001
JP 2003-153392 5/2003

*Primary Examiner*—Tuan D Nguyen
(74) *Attorney, Agent, or Firm*—Gallagher & Lathrop; David N. Lathrop

(57) ABSTRACT

A substrate having a metal capsule which has an open end caulked to a planar periphery portion and in which an electric apparatus is accommodated includes a substrate main body having a planar central projecting portion consisting of a resin material and a step provided on a side of the flat plate portion located opposite a mounted surface side, an annular metal member which is located between a peripheral part of the central projecting portion and a flat plate portion and which is partly exposed toward the mounted surface side like a flange, a plurality of external terminals provided on the mounted surface of the central projecting portion, a metal coat connected to the annular metal member and to at least one of the external terminals and formed along an outer surface of the central projecting portion, a plurality of internal terminals provided on an inner surface of the substrate main body located opposite the mounted surface side, ground through-holes formed in a planar peripheral portion at a position where the annular metal member is sandwiched, the ground through-holes connecting some of the internal terminals to the annular metal member, and signal through-holes formed in the substrate main body and connecting the other internal terminals to the external terminals.

5 Claims, 6 Drawing Sheets

CONDENSER MICROPHONE AND METHOD OF MANUFACTURING SUBSTRATE THEREFOR

BACKGROUND OF THE INVENTION

1. Field of the Invention

The present invention relates to a condenser microphone and a method of manufacturing a substrate used for the same, and in particular, to an electret condenser microphone, for example.

2. Description of the Related Art

FIG. 1 shows a structure corresponding to a related art for an electret condenser microphone (referred to as an ECM below). FIG. 1 shows a sectional configuration of an ECM in accordance with the related art, which is described in Japanese Patent Application Laid-Open No. 2003-153392 Official Gazette. In FIG. 1, the contour of the ECM is formed by a cylindrical capsule 61. A sound wave passing opening 610 is formed in a front plate 61*a* of the capsule 61. The following are incorporated into the capsule 61 and arranged in the following order from an inner surface of the front plate 61*a* toward the rear of the capsule 61: a diaphragm 62, an insulating spacer 63, a rear pole 64, a ring-like rear pole holder 65 consisting of an insulating material, a conductive cylinder 66, and a circuit substrate 67. In this case, the diaphragm 62 comprises a dielectric film which consists of for example, polyphenylene sulfide (also referred to as PPS) and in which a metal film such as Ni or Al is formed, as a conductive layer, on a surface of the film located closer to the rear pole. A diaphragm ring 62*a* is fixed to the periphery of a front surface of the diaphragm 62 and is in contact with the front plate 61*a*. The rear pole 64 is placed behind the diaphragm via the thickness of the insulating spacer 63 and supported by the ring-like rear pole holder 65, consisting of an insulating material. A conductive cylinder 66 is interposed between the rear pole 64 and the circuit substrate 67 to electrically connect the rear pole 64 to wiring formed on a top surface (front surface) of the circuit substrate 67. An electret layer 64*a* is formed on a front surface of the rear pole 64, that is, the surface of the rear pole 64 located opposite the diaphragm 62; the electret layer 64*a* is obtained by converting a dielectric layer such as FEP (Fluorinated Ethylene Propylene) into an electret. A circuit device 68 such as an FET (Field Effect Transistor) is mounted on a top surface of the circuit substrate 67. Solder bump electrodes 69*a* and 69*b* that are externally connected electrodes are projected from a bottom surface (rear surface) of the circuit substrate 67. For example, such a circuit as shown in FIG. 2 is formed on the circuit substrate 67.

In FIG. 2, a gate of the FET is connected to the rear pole 64 through the conductive cylinder 66, shown in FIG. 1. A source of the FET is connected to the diaphragm 62 through the capsule 61, shown in FIG. 1. Two capacitors C are connected to between a source and a drain of the FET in parallel with each other; the part between the source and drain of the FET operates as an impedance converting section. The drain of the FET is connected to an output terminal 72 (in FIG. 1, the solder bump electrode 69*b*) through a through-hole (not shown in the drawings) formed in the circuit substrate 67. The drain of the FET then leads to a DC inhibiting capacitor Cp. The source of the FET is connected to a connection terminal 71 (in FIG. 1, the solder bump electrode 69*a*) through a through-hole (not shown in the drawings) formed in the circuit substrate 67. Further, the drain of the FET is connected to a reference power source through a resistance element R. In FIG. 1, a rear end of the capsule 61 is caulked to the rear surface of the circuit substrate 67 as a caulking portion 611. The caulking allows element parts housed in the capsule 61 to be fixed to one another. If a sound wave enters the capsule 61 through the sound wave passing opening 610, it vibrates the diaphragm 62 to change the capacitance between the diaphragm 62 and the rear pole 64. This converts the sound wave into an electric signal, which is output to the output terminal 72 (in FIG. 1, the solder bump electrode 69*b*).

To mount the above ECM on a mounting substrate (not shown in the drawings), the solder bump electrodes 69*a* and 69*b* are soldered to the corresponding electrodes on the mounting substrate. That is, the ECM placed on the mounting substrate is entirely immersed in a reflow bath and then heated. The heating melts the solder bump electrodes 69*a* and 69*b* to achieve soldering. In this case, as shown particularly in FIG. 1, the solder bump electrodes 69*a* and 69*b* are projected from the bottom surface of the circuit substrate 67, with the caulking portion 611 present on the bottom surface of the circuit substrate 67 at an end of the capsule 61. This configuration presents the problem described below. When the solder is heated and melted in the reflow bath, solder melting heat distorts the caulking portion 611. This may relax the caulking or cause the molten solder and fluxes to advance between the caulking portion 611 and the circuit substrate 67. This may make the electric connection between the rear pole 64 and the wiring on the circuit substrate 67 unstable; the conductive cylinder 66 is interposed between the rear pole 64 and the wiring. The electret layer 64*a* of the rear pole 64 may be degraded to reduce the voltage applied to between the diaphragm 62 and the rear pole 64. Further, the sensitivity of the ECM may decrease.

With the reflow type ECM for which soldering is carried out using a reflow bath, the measure described below is taken to prevent solder or fluxes from advancing between the caulking portion 611 and the circuit substrate 67. If the mounting substrate is directly soldered, solder paste is accumulated between the caulking portion 611 and the mounting substrate. The caulking portion 611 is thus separated from the mounting substrate before soldering. However, this measure is not reliable.

Another measure involves applying a second substrate to the bottom surface of the circuit substrate to form such a step as projects beyond the thickness of the caulking portion 611. A solder bump electrode is then projected from the second substrate. Then, the solder is connected to the mounting substrate in the reflow bath. This amounts to the application of the substrate to the circuit substrate 67 resulting in the formation of a step. The application of the substrate to the circuit substrate 67 requires alignment at a predetermined accuracy and the formation of a through-hole for electric connection followed by an attachment operation. However, these operations preclude inexpensive circuit substrate from being obtained. Further, even if a circuit substrate is obtained by using a router to carry out machining to form a step, disadvantageously the resulting circuit substrate is not inexpensive. That is, structures with steps are expensive.

Moreover, conventional circuit substrates are mostly pattern wired substrates. Fabrication of a pattern wired substrate requires production of conductor electrodes, glass, multilayer wiring, through-holes, and the like using various materials and various printing processes. Consequently, the fabrication process is complicated and expensive.

SUMMARY OF THE INVENTION

It is an object of the present invention to provide a condenser microphone which minimizes the adverse effect of overheating in a reflow bath to preclude relaxing of a caulking portion and thus the entry of solder and fluxes into the caulking portion, thus prevent electric instability and a decrease in the sensitivity of an ECM, and a method of manufacturing a substrate therefor. It is another object of the present invention to provide a condenser microphone which is made reliable by separating the caulking portion from a mounting substrate by using a step rather than accumulating solder paste, and a method of manufacturing a substrate therefor. It is another object of the present invention to provide a condenser microphone which allows an inexpensive substrate to be obtained without using a router to carry out machining to form a step, and a method of manufacturing a substrate therefor. It is another object of the present invention to provide a condenser microphone which allows a substrate to be obtained without using various materials or various printing processes, that is, without executing a complicated and expensive manufacturing process, and a method of manufacturing a substrate therefor.

To accomplish these objects, the present invention provides a substrate including a metal capsule which has an open end caulked to a planar periphery portion and in which an electric apparatus is accommodated, the substrate comprising a planar central projecting portion comprising a resin material, and a flat plate portion connected to the central projecting portion so as to have a step on a side of the flat plate portion located opposite a mounted surface side, an annular metal member which is located between a peripheral part of the central projecting portion and the flat plate portion and which is partly exposed toward the mounted surface side, a plurality of external terminals provided on the mounted surface of the central projecting portion, a metal coat connected to the annular metal member and to at least one of the external terminals and formed along an outer surface of the central projecting portion, a plurality of internal terminals provided on an inner surface of the substrate main body located opposite the mounted surface side, ground through-holes formed in a planar peripheral portion at a position where the annular metal member is sandwiched, the ground through-holes connecting some of the internal terminals to the annular metal member, and signal through-holes formed in the substrate main body and connecting the other internal terminals to the external terminals.

Thus, the annular metal member consisting of for example, a metal plate for a lead frame. The substrate consists of the resin material and comprises the planar periphery portion and the central projecting portion. Accordingly, the present substrate requires a simpler manufacturing process and is more inexpensive than the conventional pattern wired substrate. Further, the present substrate consists only of the metal and resin and thus contributes to environmental protection.

Moreover, the step portion is formed which projects from the central projecting portion. Consequently, when a caulking portion is located on the annular metal member, the step enables the caulking portion to float from the mounted surface. It is thus possible to hinder the caulking portion from being adversely affected by heat resulting from reflow and to prevent the flow-in of solder and fluxes, without accumulating solder paste, which is conventionally unreliable, stacking substrates, or performing an expensive step forming operation such as one using a router. Therefore, a microphone can be obtained the sensitivity of which is subject to few variations.

DETAILED DESCRIPTION OF THE PREFERRED EMBODIMENT(S)

With reference to the drawings, description will be given of embodiments of a condenser microphone in accordance with the present invention. In this case, description will be given taking the case of a back electret type electret condenser microphone (ECM). However, the present invention is also applicable to what is called a front electret type ECM.

First Embodiment

Figure 3A:
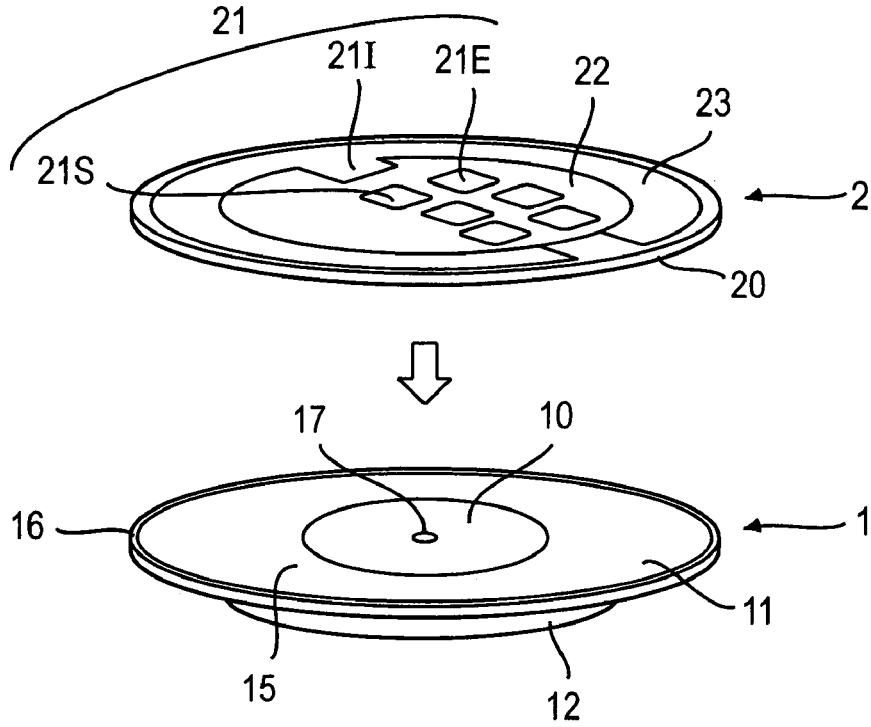
FIG. 3A is an exploded perspective view of a first embodiment of the present invention.
Figure 3B:
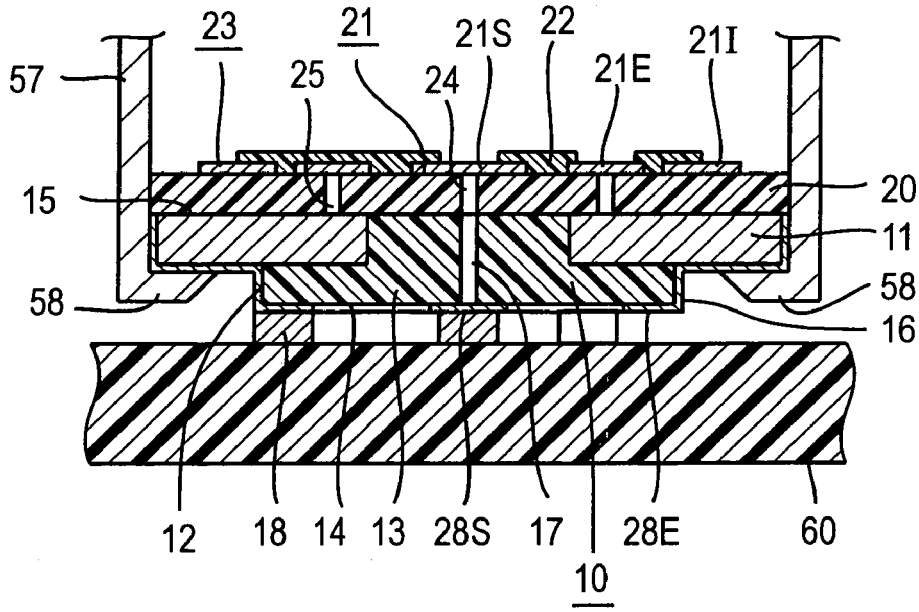
FIG. 3B is a sectional view of the first embodiment of the present invention.

FIG. 3 shows an exploded perspective view of a heat-resistant substrate adapted for a reflow bath in accordance with the present embodiment and a sectional view showing the mounted substrate. In the example shown in FIGS. 3A and 3B, the substrate as a whole consists of two parts, upper and lower parts. That is, the substrate has internal terminals on a parts mounted side corresponding to the upper side of the figure, the internal terminals including an input terminal, a ground terminal, and an output terminal. Further, the substrate has external terminals on a mounted surface side corresponding to the bottom side (lower side) of the figure, the external terminals including an output terminal and a ground terminal. A lower mold 1 corresponding to the lower part is a resin material molded portion 10 having a circle metal plate (annular metal plate) 11 placed like a flange. An upper plate 2 corresponding to the upper part is for example, a resin plate 20 having a conductor pattern 23 attached to the upper flat surface and covered with a resist film 22 from which terminals 21 (21I, 21E, 21S) are exposed.

More specifically, the resin material molded portion 10 of the lower mold 1 has a central projecting portion 13 provided on a mounted surface side and having a flat surface 14 projecting so as to form a step 12. Apart of the circular plate 11 projects from an outer periphery of the central projecting portion 13 like a flange and is exposed toward the mounted surface side. A surface of the lower mold 1 located opposite the mounted surface side constitutes a flat surface 15 consisting of a top surface of the circular plate 11 and a top surface of that part of the resin material molded portion 10 which fills the inside of the circular plate 11. Moreover, a metal coat 16 consisting of for example, gold plating, adheres to an area covering a peripheral top surface of the circular plate 11, an exposed outer peripheral surface and bottom surface of the circular plate 11, an outer side surface of the central projecting portion 13 of the resin material molded portion 10, and peripheral portions of the step 12 and flat surface 14. The metal coat 16 plays a double role; the metal coat 16 offers conductivity and prevents oxidization. Accordingly, the metal coat 16 is preferably gold plating and covers oxidizable parts to prevent oxidization. On the flat surface 14 of the central projecting portion 13, an inner peripheral end of the metal coat 16 is used as a ground terminal 28E that is an external terminal 28. Further, a signal terminal 28S that is an external terminal 28 is provided on the flat surface 14 and is connected to a central through-hole 17 penetrating the resin material molded portion 10. The signal terminal 28S is formed of the same material as that of the metal coat 16 simultaneously with the formation of the metal coat 16. The mounted surface sides of the ground terminal 28E and signal terminal 28S are fixed to a mounting substrate 60 with solder 18. The resin forming the resin material molded portion 10 is resistant to heat and withstands heating in a reflow bath. The resin consists of a material such as PA6T (polyamide 6T), PPS (polyphenylene sulfide), or LCP (Liquid Crystal Polymer).

Figure 4:
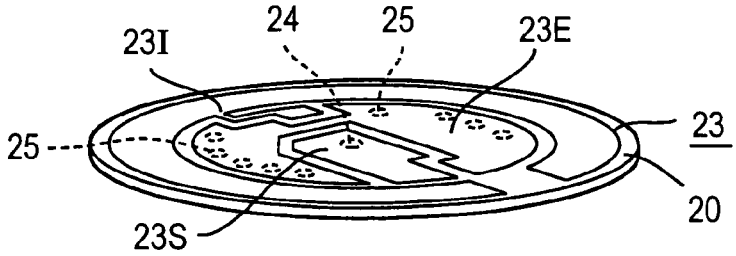
FIG. 4 is a perspective view showing a conductor pattern on a substrate.

On the other hand, the upper plate 2 is a disk-like resin plate 20 consisting of for example, a glass epoxy substrate having a diameter substantially equal to that of external shape of the circular plate 11. A conductor pattern 23 is formed on the resin plate 20 as shown in FIG. 4. In FIG. 4, the resin plate 20 consists of a resin pattern film having a metal foil such as a copper foil formed on one surface. For example, a photolithography method is used to remove the metal foil to form an input conductor pattern 23I, a ground conductor pattern 23E, and a signal output conductor pattern 23S. The conductor patterns 23I, 23E, and 23S are generally called the conductor patterns 23 which are patterns connecting the circuit such as impedance conversion. A resist film 22 of an electrical insulation material is applied to the conductor patterns 23. Windows are each formed in the resist film 22 to expose at least a part of the corresponding one of the conductor patterns 23. The exposed part of each conductor pattern 23 constitutes the input terminal 21I, the ground terminal 21E, or the signal output terminal 21S. The resin plate 20 has a through-hole 24 formed immediately below the signal output conductor pattern 23S and connected to the signal output conductor pattern 23S. The resin plate 20 also has a plurality of through-holes 25 formed immediately below the ground conductor pattern 23E and connected to the ground conductor pattern 23E. The through-hole 24 is located at the same two-dimensional position as that of the through-hole 17 in the resin material molded portion 10. In this example, both through-holes are formed at a central position. The through-holes 25, connected to the ground conductor pattern 23E, are formed in association with two-dimensional positions on the circular plate 11.

Prepreg is used to bond the flat bottom surface of the resin plate 20 to the upper flat surface 15 of the resin material molded portion 10. The material of the resin plate 20 may be ceramic. That is, the resin plate 20 has only to be an insulating substrate.

Figure 1:
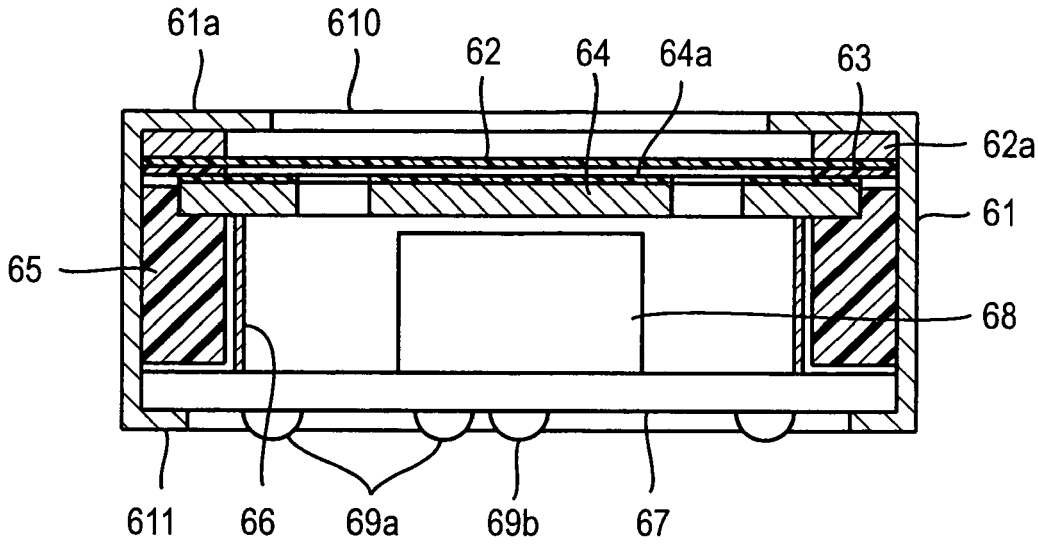
FIG. 1 RELATED ART
FIG. 1 is a sectional view illustrating a related art for an ECM.

Now, description will be given of a method for manufacturing the substrate shown in FIG. 1. To form a lower mold 1, first, the circular plate 11 is internally filled with an insert mold of a resin material. Further, a planar central projecting portion 13 having a step 12 is formed on the mounted surface side. A resin material molded portion 10 is formed with a through-hole 17 formed in the center (axis) of the resin material molded portion 10. Subsequently, the metal coat 16 consisting of for example, gold plating, is attached to an area covering the top surface of the circular plate 11, the outer peripheral surface of the circular plate 11, the part between the outer peripheral surface and the central projecting portion 13, the outer peripheral surface of the central projecting portion 13, and the peripheral portion of the lower flat surface 14.

On the other hand, to form an upper plate 2, a through-hole 25 for a ground conductor pattern is formed in the resin plate 20 with its front and back surfaces both flat. Further, a through-hole 24 for a signal output conductor pattern is formed. Subsequently, conductor patterns 23 are formed on the upper flat surface of the resin plate 20. Furthermore, the resist film 22 is coated on the conductor pattern 23 via a mask to expose a ground terminal 21E, an output terminal 21S, and an input terminal 21I. Subsequently, for example, prepreg is used to bond the upper flat surface 15 of the lower mold 1 to the flat bottom surface of the upper plate 1 in such a way that both surfaces are centered. In this case, the through-holes 24 and 17 are aligned with each other, with the through-hole 25 aligned with the circular plate 11. The substrate is thus produced.

FIG. 3B shows a structure in which the substrate shown in FIG. 3A is composed of an ECM and in which an open end of a capsule 57 is caulked to the flange portion of the circular plate 11 to form a caulking portion 58. The figure also shows that the ECM substrate is soldered to the mounting substrate 60 in a reflow bath. In this case, the step 12 has a thickness larger than that of the caulking portion 55 of the capsule 57. The solder 18 is for example, 100 μm in thickness. As shown in FIG. 3B, the solder 18 is attached so as to project from the step 12. Accordingly, the step 12 has only to be as thick as or thicker than the caulking portion 58. If the step is excessively thick, when the ECM is mounted on the mounting substrate 60, the height is too large. The step 12 is desirably thinner for miniaturization. Accordingly, when the caulking portion 58 is 0.15 mm in thickness, the step 12 desirably has a thickness of about 0.15 to 0.2 mm. That is, the distance from the caulking portion 58 to the ground terminal 28E and signal terminal 28S on the step 12 across the thickness of the substrate is desirably between about 0 and 0.05 mm.

Second Embodiment

Figure 5A:
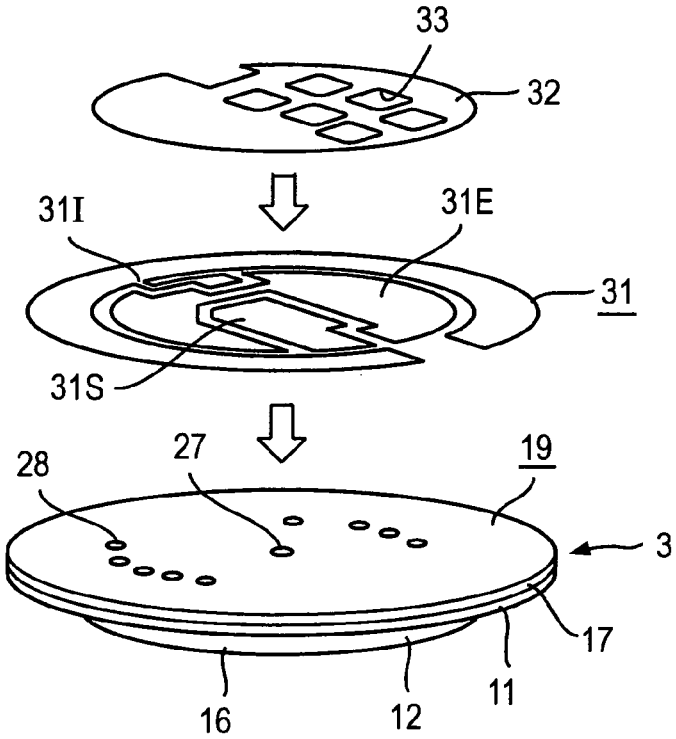
FIG. 5A is an exploded perspective view of a second embodiment of the present invention.

FIG. 5 shows a second embodiment of the present invention. In the second embodiment, the arrangements described below are formed without forming the upper plate as in the case of the first embodiment. The circular plate 11 is embedded in the lower mold 1 in FIG. 3A (in FIG. 5 in accordance with the present embodiment, simply a mold 3). A mold upper part 17 is formed in place of the upper part 2 in FIG. 3A. The mold upper part 17 is integrated with the bottom central projecting portion 13. The flat top surface of the mold upper plate 17, that is, the upper flat surface 19 of the mold 3 is coated with conductor pattern films 31 (31I, 31E, and 31S) and a resist film 32. In FIG. 5, the same components as those in FIG. 3 have the same reference numerals.

In FIG. 5, a mold 3 is formed by for example, insert molding so as to sandwich the circular metal plate (annular metal plate) 11. In this case, in order that a flange may be formed on the mounted surface side of the circular plate 11, the diameter of the central projecting portion 13 is smaller than the outer diameter of the circular plate 11. The surface of the circular plate 11 located opposite the mounted surface is entirely covered with the mold upper part 17, located opposite the mounted surface of the circular plate 11. Through-holes 28 are formed in the mold upper plate 17 at the positions corresponding to the through-hole 25 in accordance with the first embodiment. A ground conductor pattern film 31E, an input conductor pattern 31I, and a signal output conductor pattern film 31S (collectively referred to as conductor pattern films 31) adheres to the flat top surface 19 of the mold upper plate 17 at relational positions similar to those in the first embodiment; the ground conductor pattern film 31E, the input conductor pattern 31I, and the signal output conductor pattern film 31S have the same sizes and shapes as those of the ground conductor pattern 23E, input conductor pattern 23I, and signal output conductor pattern 23S in accordance with the first embodiment, and consist of for example, a copper foil. Moreover, a resist film 32 adheres to the adhering conductor pattern film 31 in a positional relationship similar to that in the first embodiment; the resist film 32 has a shape similar to that of the resist film 22 in accordance with the first embodiment and consists of an electric insulation material. Consequently, the conductor pattern films 31E, 31I, and 31S are partly exposed from corresponding windows 33 formed in the resist film 32 to constitute the ground terminal, the input terminal, and the signal output terminal. It is possible to adhere the resist film 22 as in the case of the first embodiment instead of using the resist film 32. As in the case of the first embodiment, the metal coat 16 is formed on the exposed surface of the circular plate 11, the periphery of mounted surface side of the central projecting portion 13, and the like. The signal terminal 28S connected to the through-hole 27 is formed in a central portion of mounted surface of the central projecting portion 13 simultaneously with the formation of the metal coat 16.

The ground terminal 28E and signal terminal 28S on the mounted surface side are fixed to the mounting substrate 60 with solder 18. Here, the resin forming the mold 3 is resistant to heat and withstands heating in a reflow bath. The resin consists of a material such as PA6T (polyamide 6T), PPS (polyphenylene sulfide), or LCP (Liquid Crystal Polymer).

A method of manufacturing the substrate as shown in FIG. 5 is described.

To form a mold 3, a circular plate 11 is first subjected to a resin mold in insert molding such that the circular plate 11 is sandwiched from above and below, while a planar central projecting portion 13 having a step 12 on the mounted surface side is formed. In this case, a through-hole 27 for signals and a through-hole 28 for ground are formed in the resin mold. Thereafter, a metal coat 16 consisting of gold plating, for example, is applied to from a side outside in which the circular plate 11 is exposed to the step 12 of the insert molded portion 10 and the flat surface 14.

The mold 3 has conductor pattern films 31E, 31I, 31S applied to its top flat face. The conductor patterns 31E, 31I, 31S are circuit patterns consisting of copper foil patterns, for example. The conductor patterns 31E, 31I, 31S have a resist film 32 having a window 33 or a resist 22 applied to and the window 33 is opened at a desired position. And, the window 33 which is formed on a portion of the resist film 32 or resist film 22 is exposed as a terminal. Then, the through-hole 27 in the mold 3 corresponding to the terminal which is the window 33 is provided corresponding to a signal terminal 28S and the through-hole 28 is provided corresponding to the circular plate 11 leading to the ground terminal 28E.

Figure 5B:
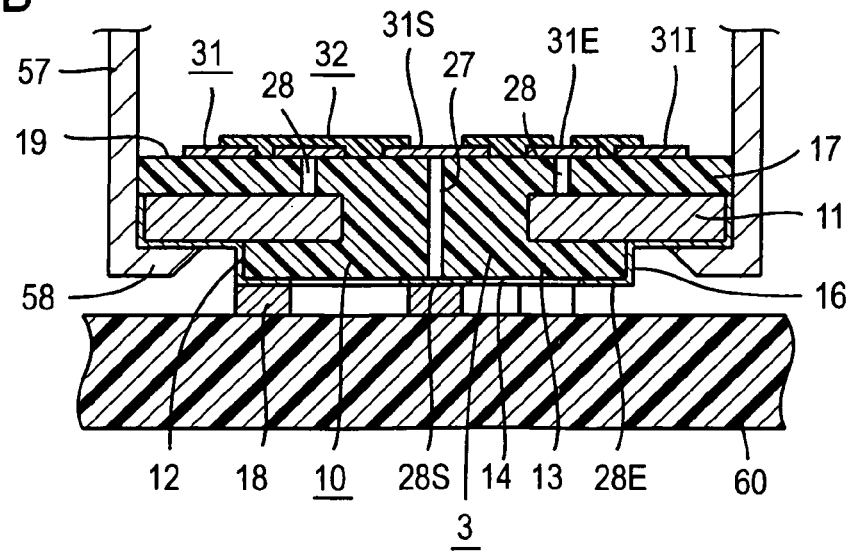
FIG. 5B is a sectional view of the second embodiment of the present invention.
Figure 6:
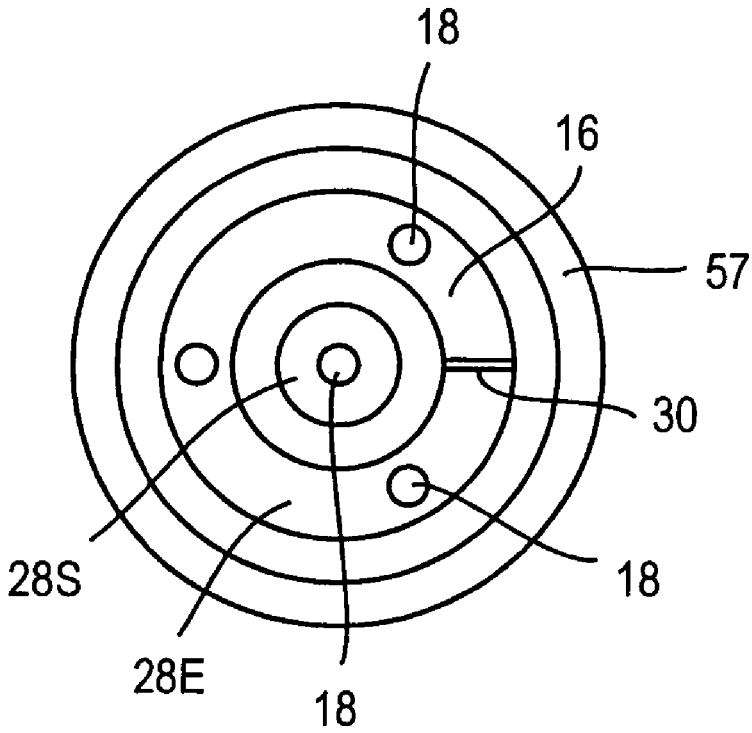
FIG. 6 is a diagram illustrating a slit in a bottom surface of the substrate.

In the first and second embodiments, in FIGS. 3B and 5B, soldering is carried out on the mounting substrate 60 in the reflow path. On this occasion, the area between the molten solder 18 on the output terminal 28S and the molten solder on the ground terminal 28E may be closed. This may thermally expand the air between the terminals to degrade the soldering. Accordingly, in FIG. 6, showing the bottom surface of the substrate to which an end of the capsule has been caulked, a slit 30 is formed in the ground terminal 28E to remove the expanded air.

As understood from the first and second embodiments, the present invention can be described in brief as follows. The microphone comprises a substrate main body consisting of an insulating material and including the bottom central projecting portion 13 and the top flat plate portion (20 and 17), which are continuously formed so as to sandwich the annular metal plate (circular plate) 11 between them. The outer peripheral portion of one surface of the annular metal plate 11 projects from the central projecting portion 13 like a flange. The flat plate portion (20 and 17) covers the entire top surface of the annular metal plate. The ground terminal 28E is formed in the peripheral portion of flat bottom surface of the central projecting portion 13 so as to connect to the annular metal plate 11. The signal output terminal 28S is formed in the central portion of the bottom surface of the central projecting portion 13. The input terminal 21I, the ground terminal 21E, and the signal output terminal 21S are formed on the flat top surface 19 of the flat plate portion (20 and 17) located opposite the annular metal plate 11. The ground terminal 21E is connected to the annular metal plate 11 through the through-holes 25 and 28 formed in the flat plate portion. The signal output terminal 21S is connected to the external signal output terminal 28S through the through-holes 24, 17, and 27 formed through the flat plate portion and central projecting portion.

Figure 2:
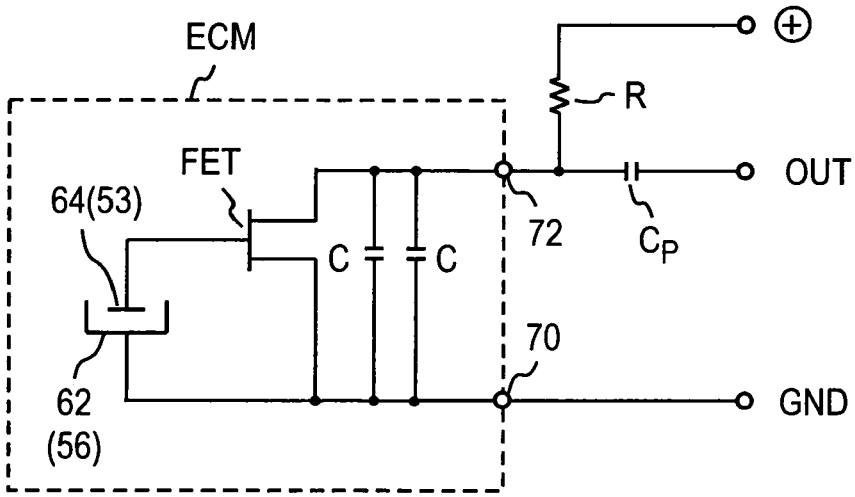
FIG. 2 is a circuit diagram of an ECM.
Figure 7:
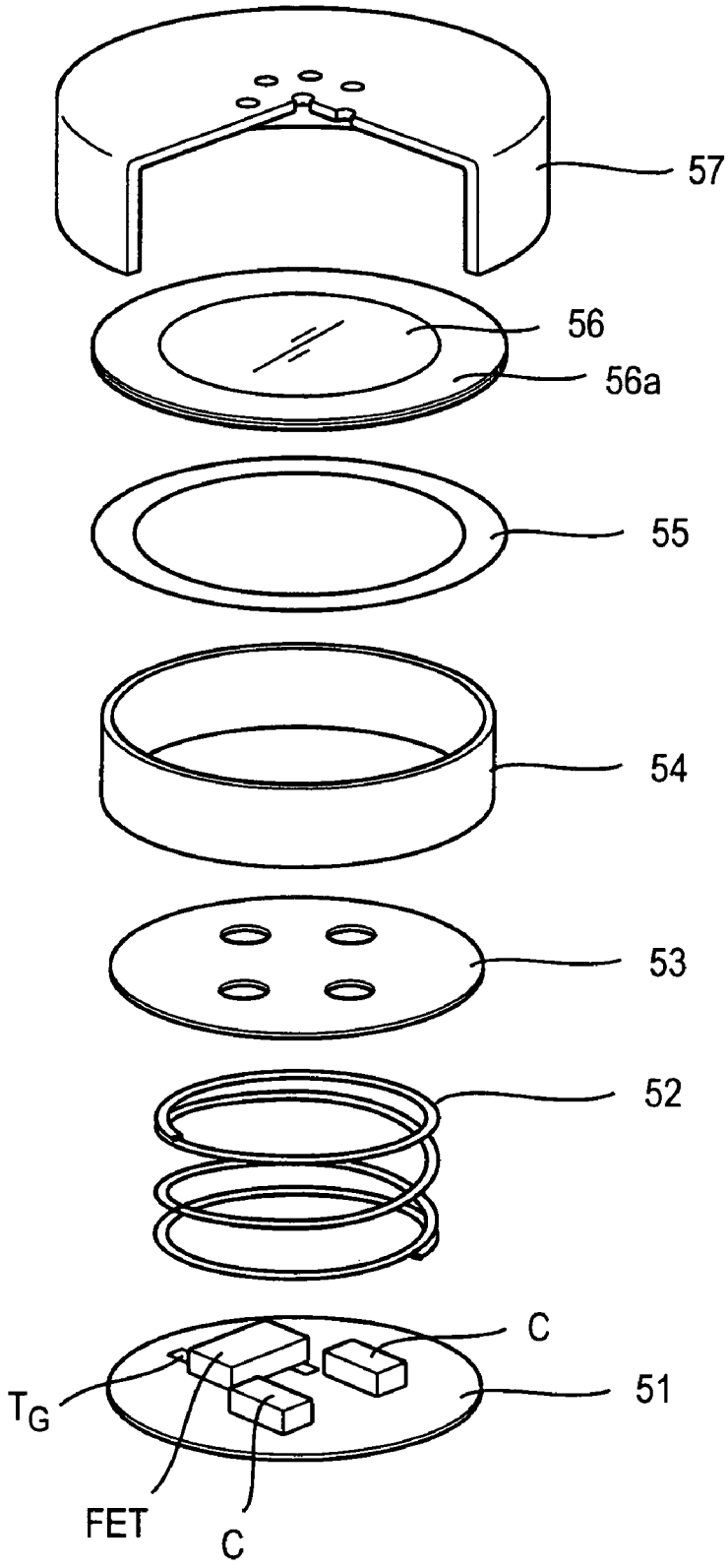
FIG. 7 is an exploded view showing an example of configuration of the ECM.
Figure 8:
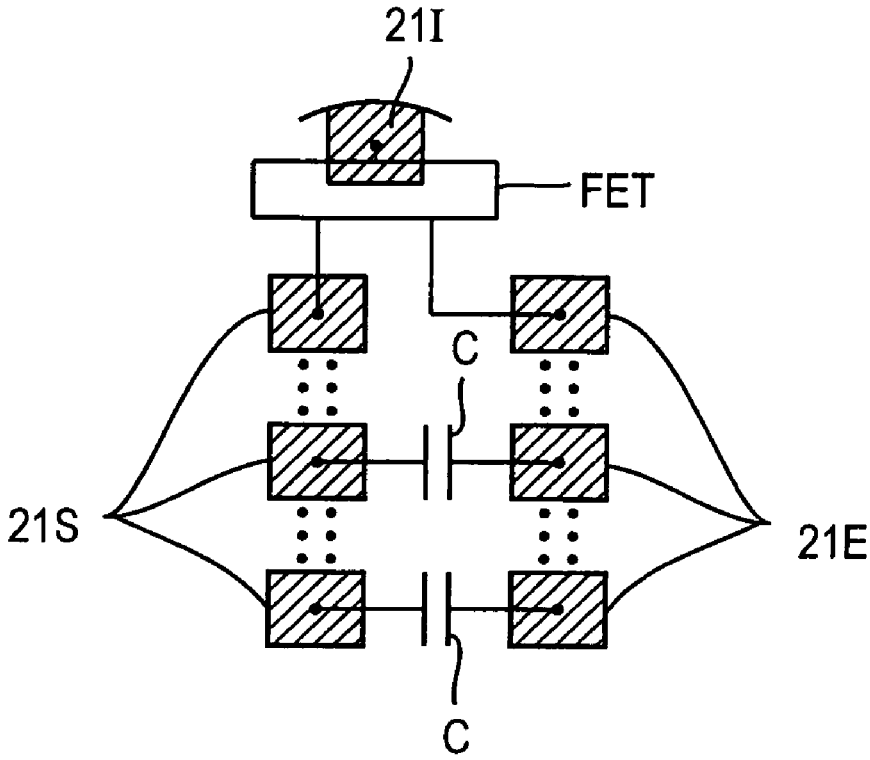
FIG. 8 is a diagram showing how elements and connection terminal are connected together.

FIG. 7 is an exploded perspective view showing that a circuit board is formed using the substrate formed in FIGS. 3 to 5 and is then used to form an ECM. In this exploded perspective view, a coil spring 52 is interposed between a circuit substrate 51 and a rear pole 53 to ensure contact based on the force of the spring exerted when the ECM is sealed. In this case, the coil spring 52 and the rear pole 53 are located in a holder 54. A diaphragm 56 is placed on the rear pole 53 via a spacer 55. An assembly extending from the circuit substrate 51 to the diaphragm 56 is incorporated into the capsule 57. The end of the capsule 57 is caulked to the annular metal member (not shown in FIG. 7) on the circuit substrate 1 for integration. That is, although not shown in FIG. 7, the bottom surface of the circuit substrate 51 has the above-described step 12 and the mounted surface side of the annular metal member is exposed. Accordingly, when the solder is melted on the bottom surface of the circuit substrate 51 in the reflow bath, since the step 12 is formed so as to project from the caulking portion 58, the thermal effect on the caulking portion 58 is reduced. This prevents solder and fluxes from flowing in between the caulking portion 58 and the bottom surface of the circuit substrate 51. Further, in FIG. 7, an FET and two capacitors C are mounted on the substrate. The substrate thus has a circuit configuration consisting of the FET and the parallel capacitors C as shown in FIG. 2 to convert a sound wave into the corresponding electric signal. The FET and the capacitors C are arranged between the output terminal 21S, which is an internal terminal, and the ground terminal 21E as shown in FIG. 8. A gate of the FET is placed on the input terminal 21I.

The above description is based on the ECM. However, since the height of the step portion can be arbitrarily set, the present invention can deal with a front electret type ECM and various other microphones. Moreover, the substrate in accordance with the present invention is applicable not only to the substrate in a microphone but also to various other substrates.

Further, in view of a simple, inexpensive substrate, since substrates can be easily formed only of a metal and resin materials simply by forming a metal plate for a lead frame into a circle, it is possible to obtain substrates totally different from conventional pattern wired substrates.

What is claimed is:

1. A condenser microphone comprising a substrate which is accommodated in a cylindrical metal capsule having a sound collecting hole at one end and on which a diaphragm, a rear pole, a holder, and an impedance converting circuit are mounted, the cylindrical capsule having the other end caulked to an outer surface of the substrate so as to form a caulking portion, thus fixing internal parts, wherein the substrate comprises:

an annular metal plate;

a substrate main body comprising an insulating material and including a flat plate portion covering an entire surface of the annular metal plate located opposite a mounted side and a central projecting portion connected to the flat plate portion through an interior of the annular metal plate to project an outer peripheral surface of the mounted side of the annular metal plate;

an external ground terminal formed in an outer peripheral portion of a flat surface of a mounted side of the central projecting portion and connected to the annular metal plate through an outer surface or a through-hole and an external signal output terminal formed in a central portion of the central projecting portion away from the external ground terminal;

an internal ground terminal formed on a flat surface of the flat plate portion located opposite a mounted side and connected to the annular metal plate through a through-hole, an internal signal output terminal formed in a central portion of the flat plate portion away from the other terminals and connected to the external signal output terminal through a through-hole, and an input terminal formed away from the internal terminals and connected to an input side of the circuit.

2. The microphone according to claim 1, wherein in the substrate main body, the flat plate portion is constructed separately from and bonded to other parts including the central projecting portion.

3. The microphone according to claim 1, wherein in the substrate main body, the flat plate portion is integrated with the central projecting portion through an interior of the annular metal plate so as to form a mold of a resin material.

4. The microphone according to claim 1, wherein a metal coat is formed over an outer peripheral surface of the annular metal plate, a projecting surface of the annular metal plate, an outer peripheral surface of the central projecting portion, and an outer peripheral portion of the flat surface of the central projecting surface, with the metal coat in the outer peripheral portion constituting the external ground terminal, and the caulking portion is pressed and fixed to the metal coat on the projecting surface.

5. The microphone according to claim 1, wherein the thickness of the central projecting portion is the same as or larger than that of the caulking portion.

* * * * *